US006558189B2

(12) United States Patent
Groebe et al.

(10) Patent No.: US 6,558,189 B2
(45) Date of Patent: May 6, 2003

(54) CONNECTOR SYSTEM FOR USE WITH HANDHELD COMPUTERS AND ACCESSORY DEVICES

(75) Inventors: Daniel P. Groebe, Lake Zurich, IL (US); Eric Fuhs, Crystal Lake, IL (US)

(73) Assignee: Palm, Inc., Santa Clara, CA (US)

( * ) Notice: Subject to any disclaimer, the term of this patent is extended or adjusted under 35 U.S.C. 154(b) by 0 days.

(21) Appl. No.: 09/808,692

(22) Filed: Mar. 14, 2001

(65) Prior Publication Data

US 2002/0132521 A1 Sep. 19, 2002

(51) Int. Cl.[7] ..... H01R 13/60
(52) U.S. Cl. ..... 439/529; 439/357
(58) Field of Search ..... 439/529, 534, 439/929, 165, 141, 341, 357; 361/686, 683, 684, 685, 687

(56) References Cited

U.S. PATENT DOCUMENTS

| | | | | | |
|---|---|---|---|---|---|
| 5,052,943 | A | * | 10/1991 | Davis | 439/357 |
| 5,220,270 | A | | 6/1993 | Peickert | 320/2 |
| 5,387,134 | A | * | 2/1995 | Bryce et al. | 439/660 |
| 5,627,727 | A | * | 5/1997 | Aguilera et al. | 361/686 |
| 6,042,414 | A | | 3/2000 | Kunert | 439/374 |
| 6,071,141 | A | * | 6/2000 | Semmeling et al. | 439/353 |
| 6,108,200 | A | | 8/2000 | Fullerton | 361/686 |
| 6,115,248 | A | | 9/2000 | Canova et al. | 361/686 |
| 6,283,777 | B1 | | 9/2001 | Canova et al. | 439/218 |
| 6,398,577 | B1 | * | 6/2002 | Simmel et al. | 439/357 |

* cited by examiner

*Primary Examiner*—Renee Luebke
*Assistant Examiner*—Phuong-Chi Nguyen
(74) *Attorney, Agent, or Firm*—Van Mahamedi; Hickman Palermo Truong & Becker LLP

(57) ABSTRACT

A connector assembly is provided for use with a handheld computing system. The connector assembly includes a first connector including a plurality of contact elements. A second connector resides on a cradle and includes a plurality of contact elements that mate with the contact elements on the handheld computer. A coupling structure is configured to extend from the cradle and to couple to the handheld computer. The coupling structure causes a portion of the handheld computer to bias into the cradle so as to direct the first connector to remain in contact with the second connector.

2 Claims, 14 Drawing Sheets

CONNECTOR SYSTEM FOR USE WITH HANDHELD COMPUTERS AND ACCESSORY DEVICES

BACKGROUND OF THE INVENTION

1. Field of the Invention

This invention relates to the field of connectors. In particular, the invention relates to connectors for handheld computers and accessory devices.

2. Description of the Related Art

FIG. 20 is a handheld computer 400. Examples of handheld computers include PALM PILOT, PALM III, PALM V, PALM VII, PALM m100, and other devices that use PALM OS, an operating system for appliances. Other types of handheld computers operate a WINDOWS OS, including WINDOWS POCKET PC and WINDOWS CE. Still further, handheld computers such as mobile phones may operate applications and browsers for cell-phones using a wireless access protocol (WAP) and languages such as Handheld device Markup Language (HDML), Wireless Markup Language (WML), and Compact Hypertext Transfer Protocol (CHTML).

The handheld computer 400 includes a front panel 402 extending between a top 406 and a bottom 408. The front panel 402 includes a display 410. The display 410 may be touch-sensitive, to enable users to enter input using a stylus or other pointed that contacts display 410. A plurality of mechanical actuators (such as buttons) 415 reside on the front panel 410. The actuators may also be used to open applications, navigate and enter input. A navigation or scroll button 416 may be used to configure information appearing on the display.

FIG. 21 illustrates a back panel 422 of the handheld computer 400. The back panel 422 includes a connector 425. The connector 425 may be used to connect the handheld computer 400 to an accessory device 450 (See FIG. 22). Examples of accessory devices include communication cradles and cradles, battery rechargers, and other resources having external power, memory, and/or processing resources. In particular, the communication cradles may be used to synchronize information on the handheld computer 400 with information on a personal computer.

FIG. 22 illustrates a communication cradle 450 for use with a handheld computer. The accessory device includes a connector 455 to connect with the connector 425 of the handheld computer 400. The cradle 450 includes a platform 460 to support the bottom 408 handheld computer 400. A back surface 462 supports the back panel 422 of the handheld computer 400. A cable 465 extends a cable connector 468 to another computer system, such as a personal computer. The handheld computer can pass and receive information through connector 425 and connector 455. The information can be extended to the personal computer via cable 465 and cable connector 468.

In general, handheld computer 400 rests on cradle 450. The handheld computer 400 needs to be lifted upwards from the platform 460 before being decoupled from cradle 450.

SUMMARY OF THE INVENTION

A connector assembly is provided for use with a handheld computing system. The connector assembly includes a first connector including a plurality of contact elements. The first connector is adapted to reside on a handheld computer. A first coupling structure resides on the handheld computer and includes a first aperture. A second connector includes a second plurality of contact elements. The second connector is configured to reside on a cradle for a portable computer and is matable to the first connector. A latch member is configured to extend from the cradle into the first aperture to couple the cradle to the handheld computer. The latch member may bias to engage the first aperture. The latch member is positioned relative to the first connector and the second connector to create a moment that directs at least a portion of the handheld computer towards remaining on the cradle.

An advantage provided under an embodiment of the invention is that the handheld computer is provided a more secure and stable relationship with the cradle. When the handheld computer is on the cradle, the user can more easily contact the touch-sensitive display to enter information or manipulate input buttons, while reducing the possibility that the user's contact will knock the handheld computer off the cradle. Furthermore, the secure relationship between the handheld computer and cradle provides a tactile feedback to indicate to a user that the connectors of the handheld computer and cradle are properly aligned and connected.

DETAILED DESCRIPTION

A. System Overview

Figure 1:
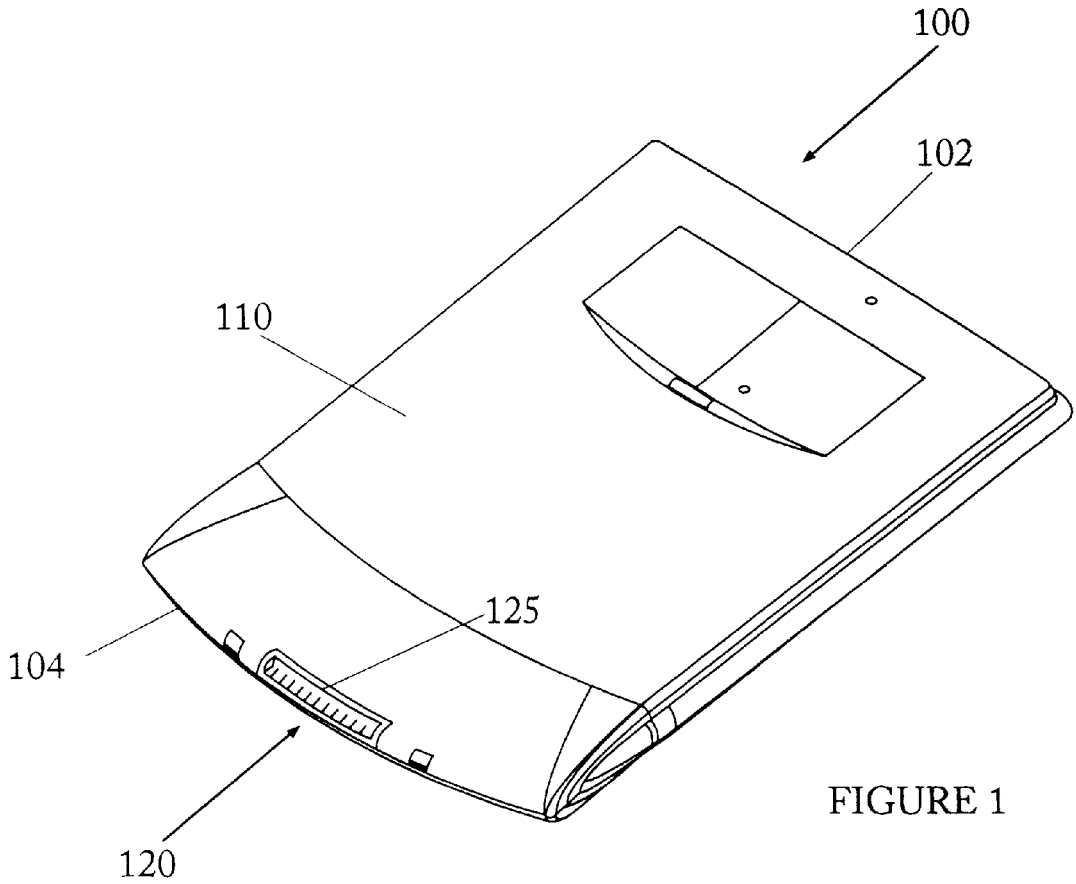
FIG. 1 is a back isometric view of a handheld computer, under an embodiment of the invention.
Figure 19:
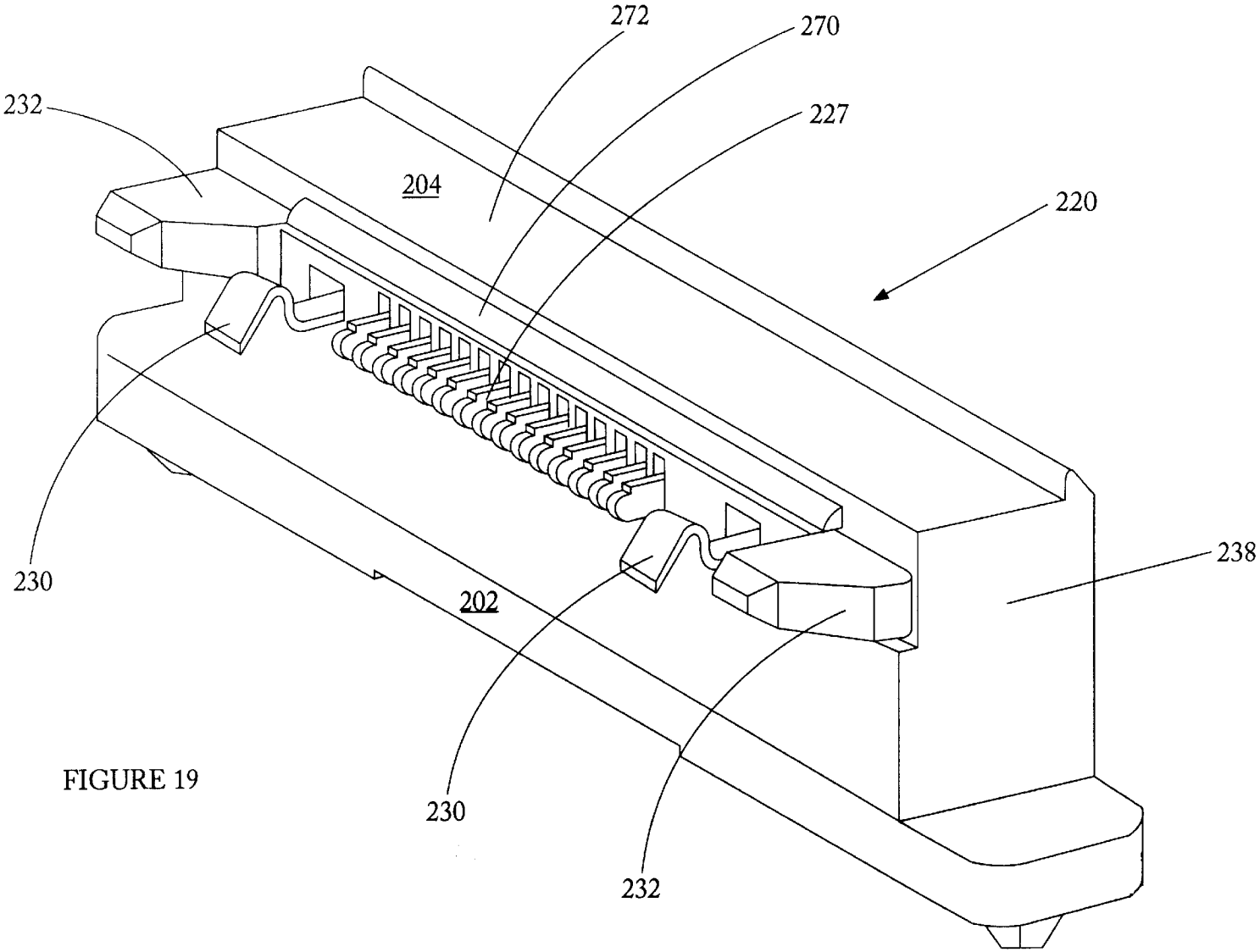
FIG. 19 is an isometric close-up view of a coupling structure for an accessory device, adapted to mate with the coupling structure of the handheld computer, under an embodiment of the invention.
Figure 20:
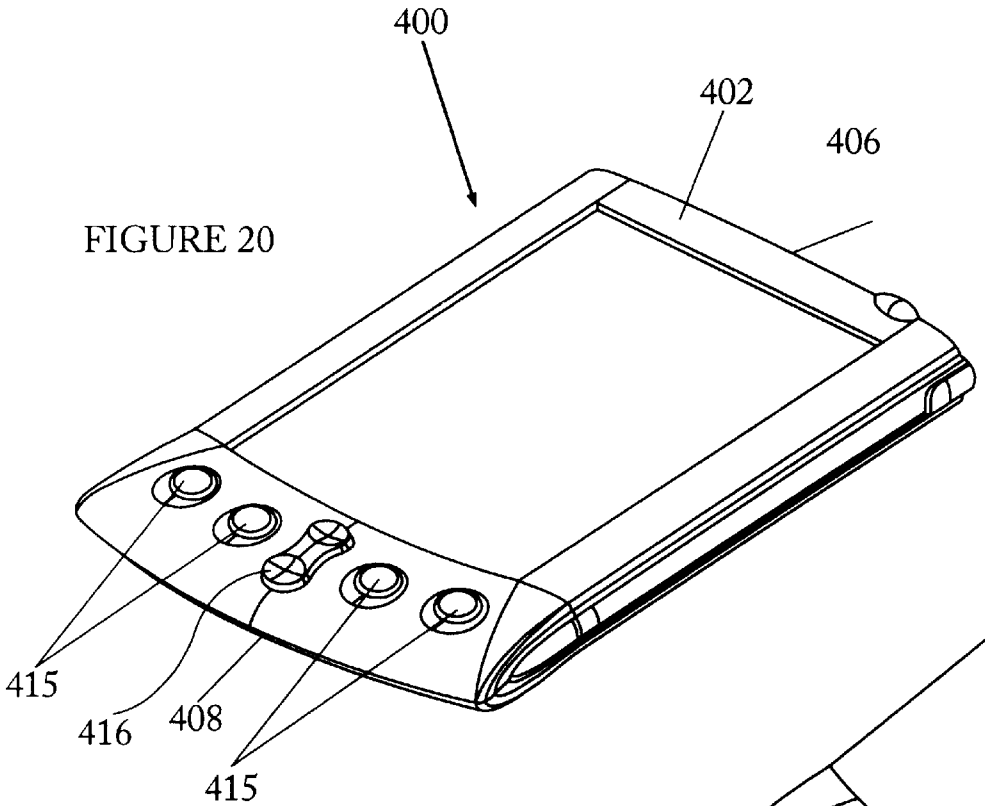
FIG. 20 is a front isometric view of a prior art handheld computer.
Figure 21:
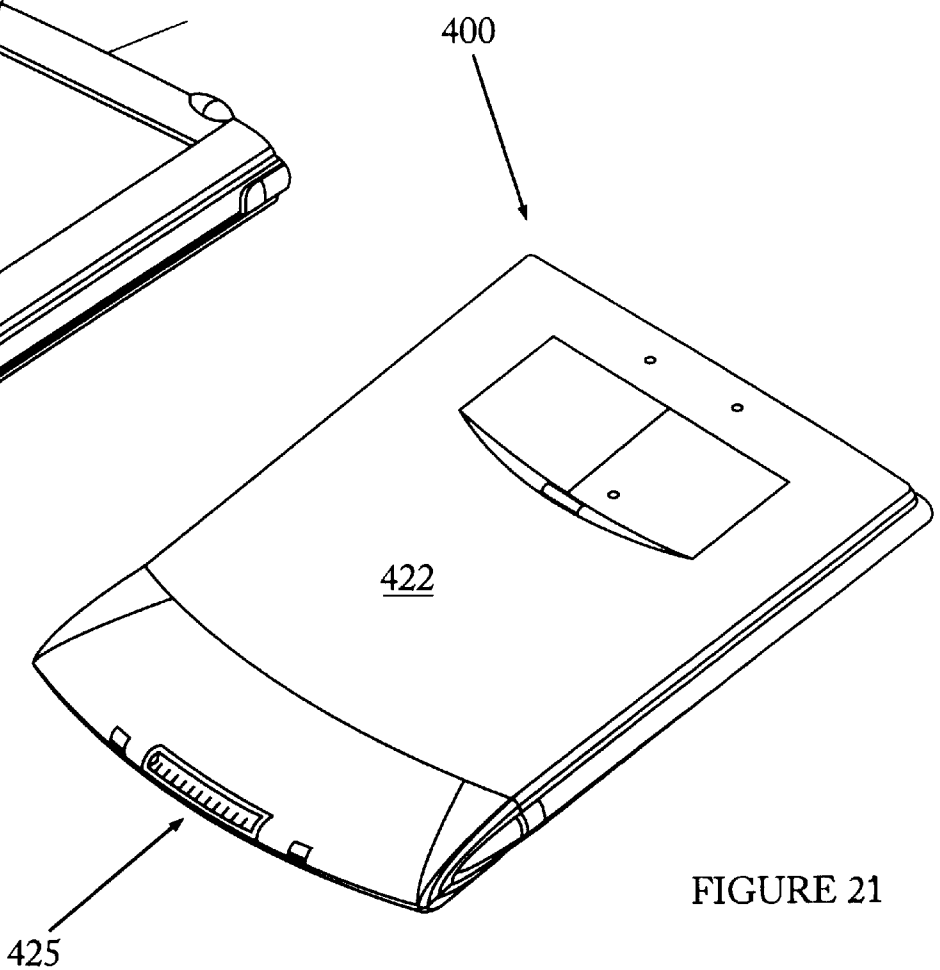
FIG. 21 is a back isometric view of a prior art handheld computer.
Figure 22:
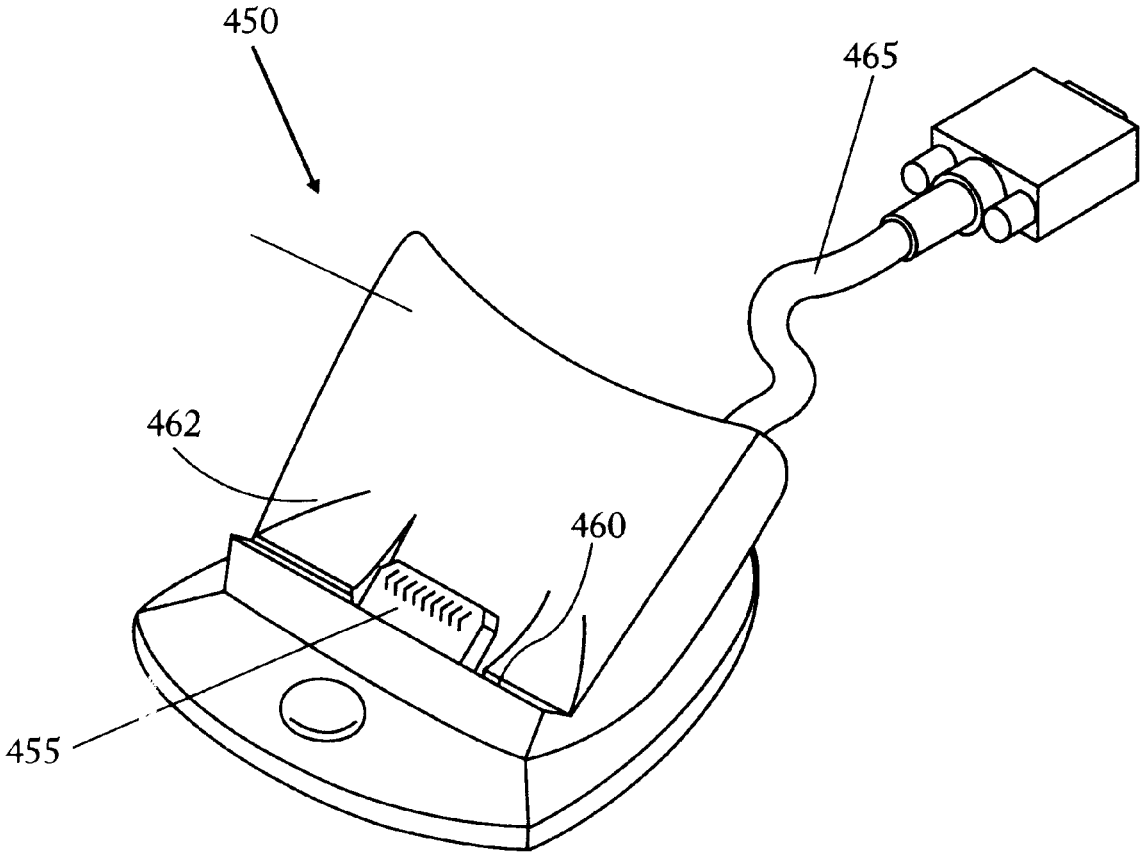
FIG. 22 is a front isometric view of a prior art cradle for use with a handheld computer.

FIG. 1 illustrates a back surface 110 of a handheld computer 100, under an embodiment of the invention. The back surface 110 extends between a top 102 and bottom 104, and opposes a front surface (see element 402, FIG. 19) having display 410 (FIG. 19). A coupling structure 120 is provided on back surface 110, or at the juncture between back surface 110 and bottom 104. The coupling structure 120 includes a set of first apertures 126 for securing a latch member from an accessory device. The coupling structure 120 also include or otherwise is integrated with a connector 125. The coupling structure 120 may be formed from an insulative structure providing the first set of apertures 126, as well as contact elements 127 (See FIG. 11) for connector 125. The handheld computer 100 also includes a second set of apertures 128 for receiving guide members 232 (FIG. 2) from cradle 200.

Figure 2:
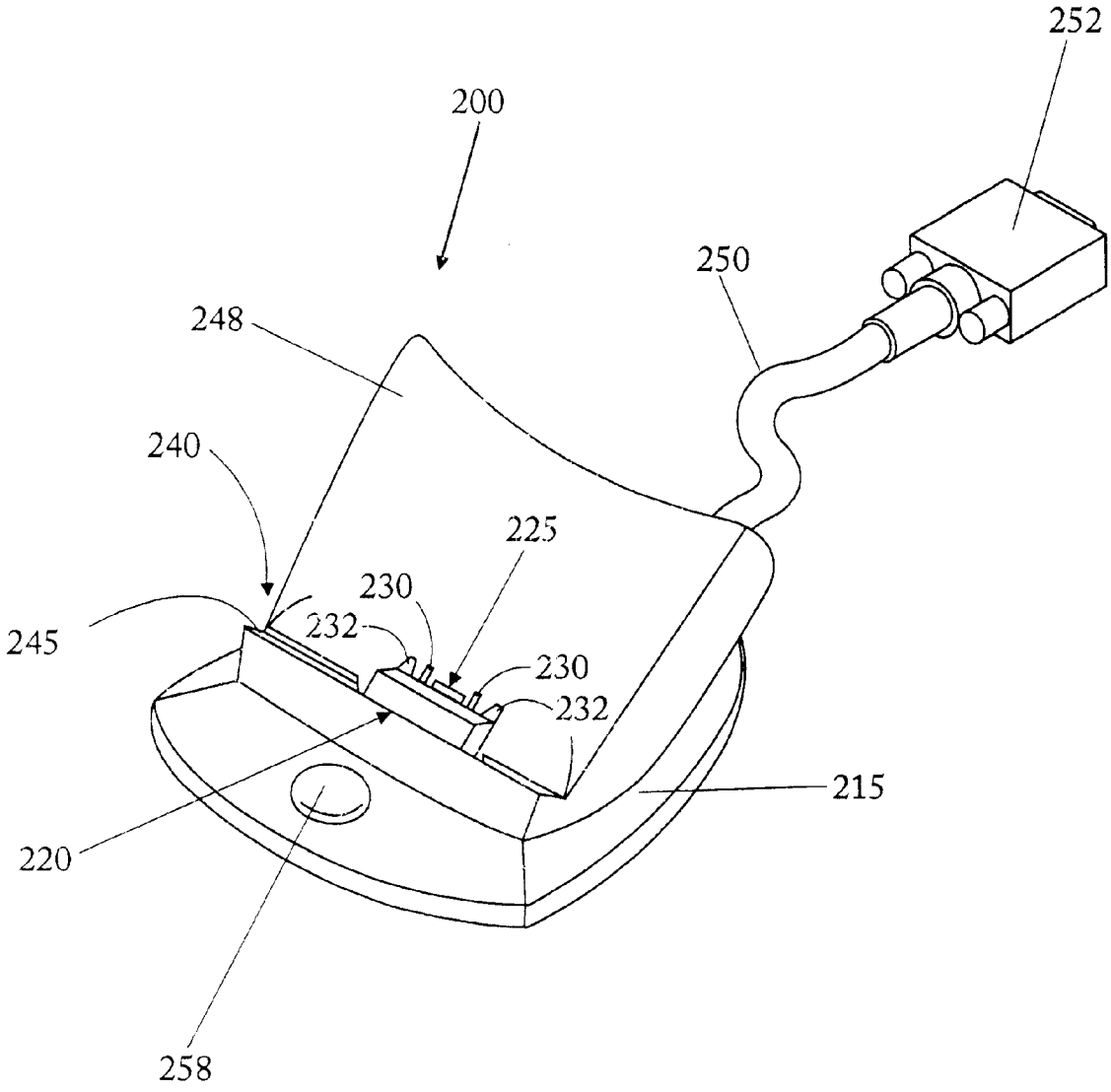
FIG. 2 is a front isometric view of a cradle for use with the handheld computer, under an embodiment of the invention.

FIG. 2 illustrates a cradle 200 for handheld computer 100, under an embodiment of the invention. The cradle 200 is a structure that acts as a docking station to store handheld computer 100 in an upright and usable position. The cradle 200 may also be equipped to perform one or more functions. For example, cradle 200 may provide connectivity to other computers so as to enable information stored on handheld computer 100 to be synchronized with similar information stored on a personal computer. Another function of cradle 200 may be to provide a power adapted to recharge the batteries of handheld computer 100.

In an embodiment shown, cradle 200 includes cradle coupling structure 220. The cradle coupling structure 220 couples cradle 200 to handheld computer 100 (FIG. 1). A cradle connector 225 included with or integrated into cradle coupling structure 220 is matable with the connector 125 (FIG. 1) of handheld computer 100. A cable 250 and cable connector 252 extend from cradle 200 to couple handheld computer 100 to another computer. A base 215 supports cradle 200. A power button 258 is actuable to cause cradle 200 to perform a function such as synchronizing the handheld computer 100 with cradle 200.

A support structure 240 retains handheld computer 100 in an upright and operable position, so that handheld computer 100 is stored in a top-down position with the display accessible to viewing and/or contact by the user. The support structure 240 includes platform 245 to support the bottom 104 of handheld computer 100. The platform 245 also includes back support surface 248 to support back surface 110 of handheld computer 100. The platform 245 and back support surface 248 may be acutely angled relative one another so that handheld computer 100 is tilted when supported on cradle 200.

In an embodiment, cradle coupling structure 220 includes a pair of latches 230. The latches 230 extend from cradle coupling structure 220 to engage corresponding apertures 126 of handheld computer. Preferably, the latches 230 extend along a vertical axis Z that is orthanormal to platform 245. The vertical axis Z extends in a direction of back support surface 248, preferably in a parallel fashion. The cradle coupling structure 220 includes a pair of guide members 232, also extending along the vertical axis. The guide members 232 engage and couple to the second pair of apertures in coupling structure 120 of handheld computer 100.

As will be further described, cradle coupling structure 220 is configured to engage and couple with coupling structure 120 so as to direct a portion of handheld computer 100 into a portion of cradle 200. The affect of the engagement between the coupling structure 120 and cradle coupling structure 220 is based on use of latches 230, as well as the position of latches 230 relative to a coupling formed by connectors 125 and 225 (see FIG. 15). The use of latches in this manner biases handheld computer 100 towards support structure 240. The latch members 230 may cause a bottom portion of back surface 110 to be pushed into back support surface 248. Furthermore, the combination of guide members 232 and the second set of apertures 128 may combine to enable handheld computer 100 to pivot about bottom 104 and away from back support surface 248 when being decoupled from cradle 200.

Figure 3:
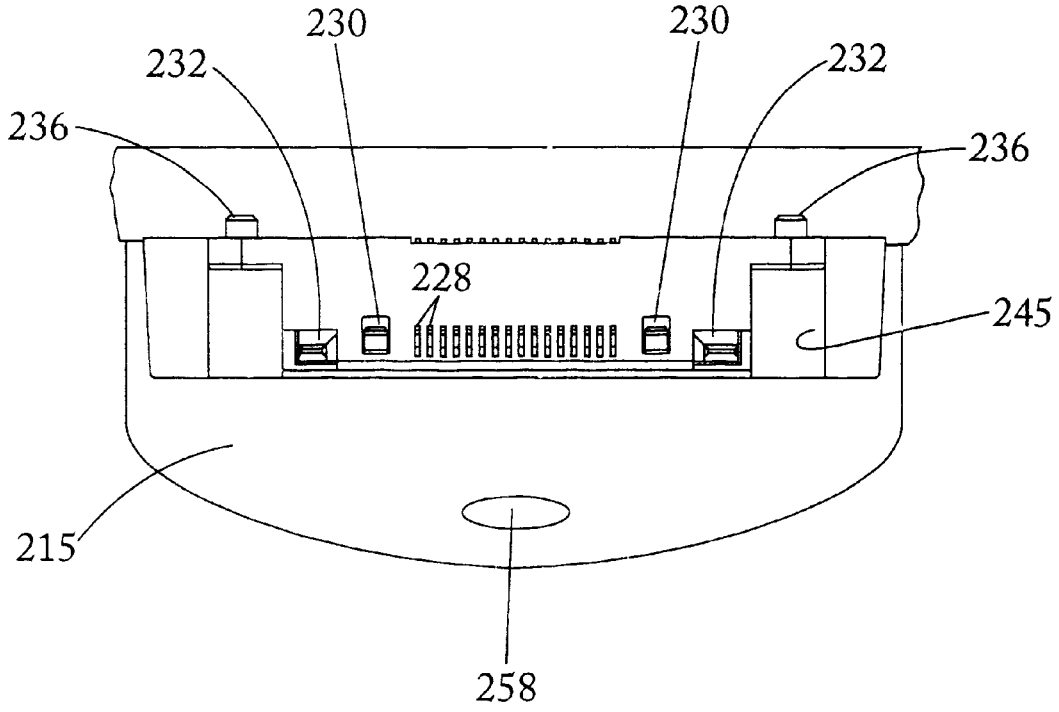
FIG. 3 is a top view of the cradle, under an embodiment of the invention.

FIG. 3 is a top view of cradle 200, under an embodiment of the invention. The cradle 200 includes base 215 extending from support structure 240. The power button 258 may be provided on an extended portion of base 215. The cradle coupling structure 220 may be formed from a component integrated with support structure 240. A pair of insertion members 236 may be used during manufacturing or assembly couple cradle coupling structure 220 to a surface of cradle 200. The cradle coupling structure 220 is provided on a portion of platform 245 of support structure 240. The position of cradle coupling structure 220 enables bottom 104 of handheld computer 100 to be dropped vertically onto platform 245 to engage coupling structure 120 with cradle coupling structure 220. When aligned, guide members 232 insert into the second set of apertures 128 on the bottom 104 of the handheld computer 100. The latches 230 engage the first set apertures 126 on handheld computer 100 to couple handheld computer 100 to cradle 200. Preferably, latches 230 and the set of first apertures 126 form a biased coupling. Once coupled, connector 125 and cradle connector 225 are in electrical contact.

B. Connector and Coupling Structure for Cradle

Figure 4:
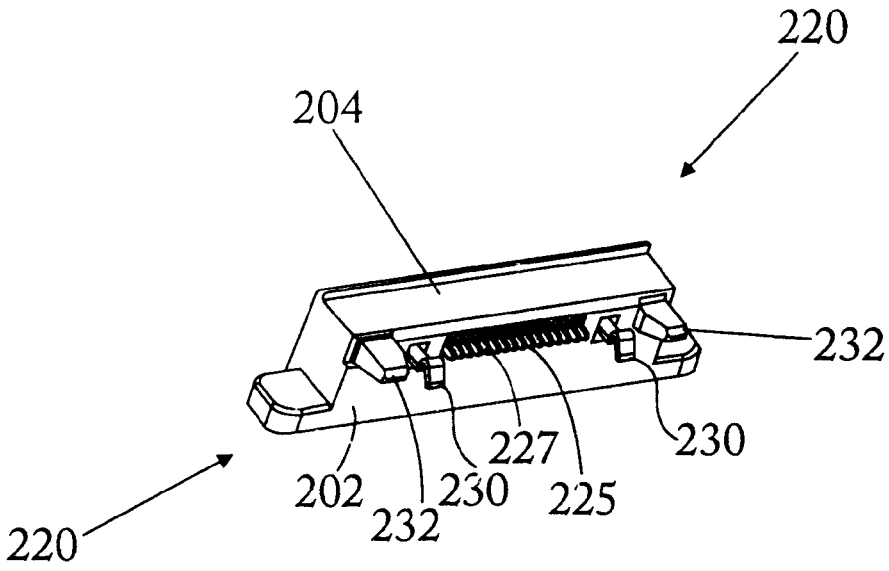
FIG. 4 is an isometric view of a cradle coupling structure for use with cradle, illustrating a contact face for engaging a handheld computer, under an embodiment of the invention.

FIGS. 4–7 illustrate cradle 200, under an embodiment of the invention. FIG. 4 illustrates cradle connector 225 formed as an integrated portion of cradle coupling structure 220. For descriptive purposes, cradle coupling structure 220 is described relative to the vertical axis Z, and a horizontal axis Y. The vertical axis Z may be parallel with back support surface 248, or may be acutely angled to back support surface 248 if cradle 200 is designed to tilt handheld computer 100. The horizontal axis Y is parallel to platform 245. A contact face 202 of cradle coupling structure 220 forms the support surface of platform 245, and extends along axis Y. For purpose of the example shown, the axis Z is orthanormal to contact face 202. A front face 204 of cradle coupling structure 220 extends along axis Y and Z.

The contact face 202 includes features of cradle coupling structure 220, including latches 230 and guide members 232. Furthermore, cradle connector 225 is positioned between latches 230 so as to mate with the connector 125 of handheld computer 100. The connector 225 is formed from a plurality of contact elements 227. Preferably, there are 16 contact elements 227 in cradle connector 225 to mate with corresponding connector elements 127 (FIG. 8) of connector 125.

Figure 5:
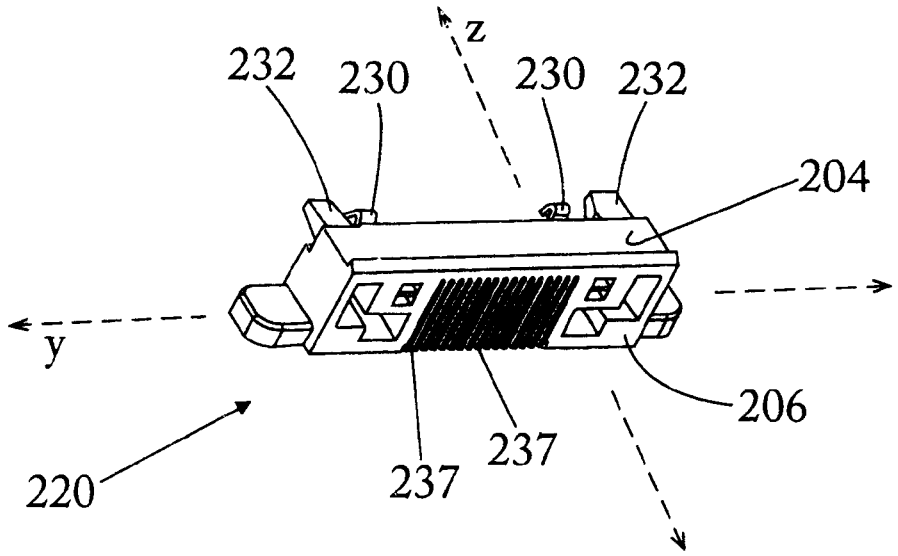
FIG. 5 is another isometric view of the cradle coupling structure, illustrating a base face opposing the contact face of the cradle coupling structure, under an embodiment of the invention.

FIG. 5 illustrates a base face 206 of cradle coupling structure 220, under an embodiment of the invention. The base face 206 opposes contact face 202 (FIG. 4) along axis Z. That is, base face 206 is proximal to base 215. The connector elements 227 of cradle connector 225 extend to leads 237 for carrying signals to leads of the external connector 250. The guide members 232 and latches 230 extend upward from contact face 202 along axis Z, opposing base face 206.

Figure 6:
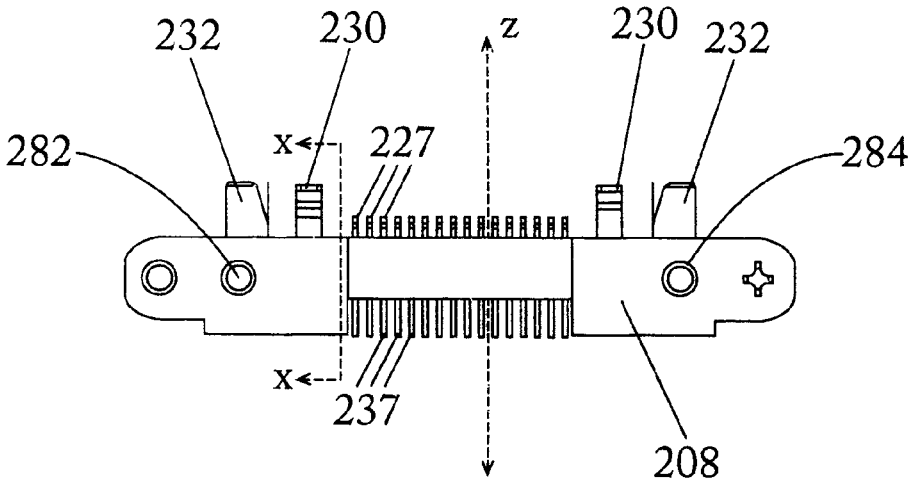
FIG. 6 is a back view of the cradle coupling structure, illustrating a back face of the cradle coupling structure, under an embodiment of the invention.

FIG. 6 illustrates a back face 208 of cradle coupling structure 220, under an embodiment of the invention. Preferably, back face 208 couples cradle coupling structure 220 to back support surface of support structure 240 (FIG. 2). The guide members 232 and latches 230 extend vertically along the Z axis to receive and couple to coupling structure 120 (FIG. 1) of handheld computer 100.

Figure 7:
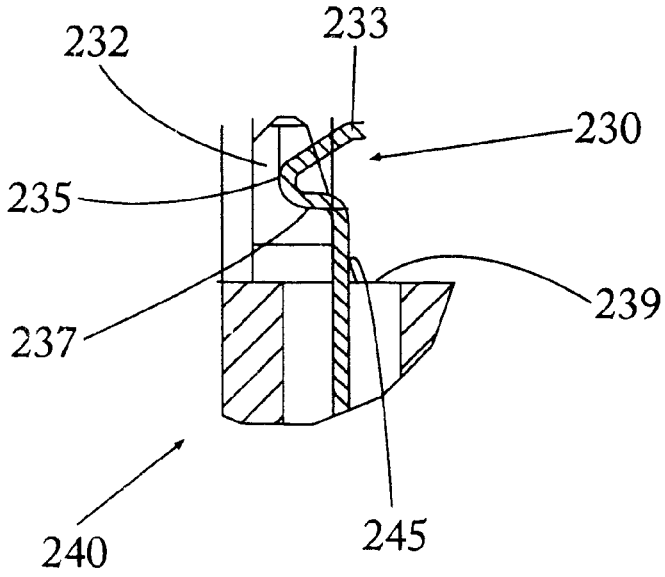
FIG. 7 is a side cross-sectional view of a latch on the cradle coupling structure engaging an aperture of a coupling structure for the handheld computer, under an embodiment of the invention.

FIG. 7 is an enlarged cross-sectional view of cradle coupling structure 220, cut long line A—A of FIG. 6, under an embodiment of the invention. The latches 230 are positioned interior to guide member 232. In an embodiment, latches 230 can be biased to engage corresponding apertures 126 of handheld computer 100. The latches 230 are bent or otherwise shaped to engage, insert into and latch within the set of first apertures 126 of handheld computer 100 when biased.

In an embodiment, latches 230 extend from a top point 233 or segment to contact face 202, defining a length of latch member along the axis Z. A base segment 239 extends into platform 245 so as to provide a bias for each of the latches 230 when the latches is pushed backwards or moved forwards. A bent segment 237 extends from base segment 239. The bent segment 237 includes a deflected point 235. Preferably, a concavity of the bent segment 237 is open towards the back support surface 248 when engaged with first aperture 126. The portion of the latch 230 extending between the top point 233 and deflected point 235 is contoured so as to catch and bend towards back support surface 248 when coupling structure 120 of handheld computer 100 is engaged with cradle coupling structure 220. The latch 230 can then engage aperture 126 of handheld computer 100. The latch 230 may return to its original position when inserted into aperture 230, thereby detachably coupling cradle 200 to handheld computer 100.

C. Combined Connector and Coupling Structure for Handheld Computer

Figure 8:
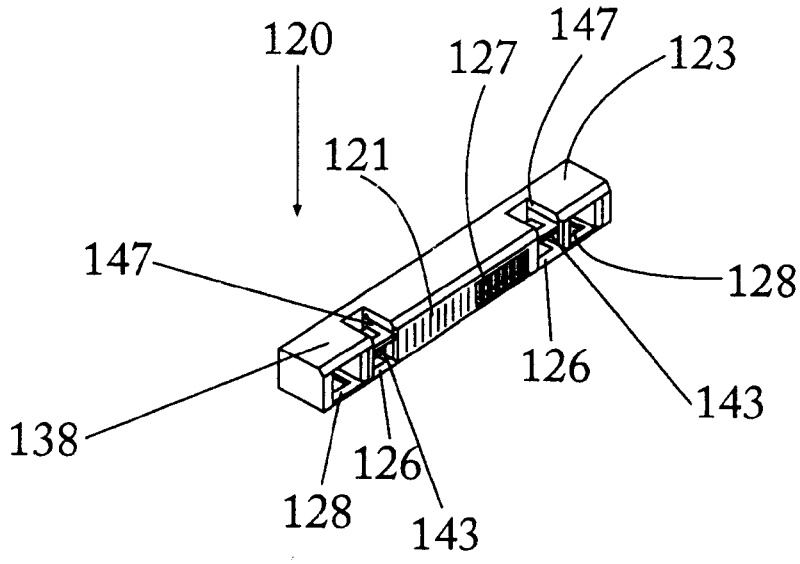
FIG. 8 is an isometric view of the coupling structure for the handheld computer, illustrating a bottom face of the coupling structure, under an embodiment of the invention.
Figure 9:
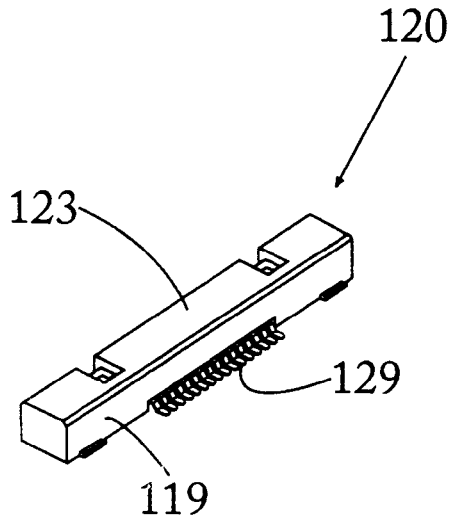
FIG. 9 is another isometric view of the coupling structure for the handheld computer, illustrating a back face of the coupling structure, under an embodiment of the invention.
Figure 10:
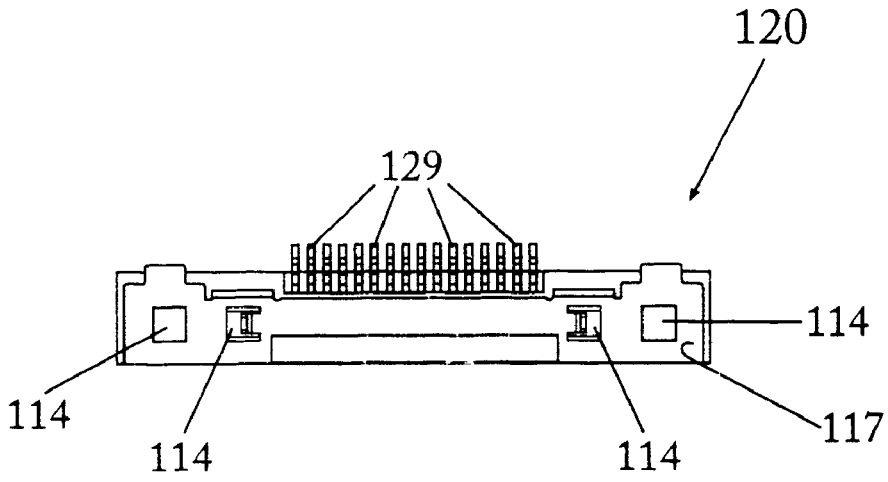
FIG. 10 illustrates a front interior face of the coupling structure for the handheld computer, under an embodiment of the invention.

FIGS. 8–10 illustrate coupling structure 120 of handheld computer 100, under an embodiment of the invention. In an embodiment, the coupling structure 120 is formed by an insulative body 138 coupled to a frame 118. Preferably, insulative body 138 is molded plastic, and frame 118 is metal or another rigid material. The coupling structure 120 includes or is otherwise integrated with connector 125. The connector 125 includes a plurality of contact elements 127 that electrically contact elements 227 (FIG. 2) of cradle connector 225. In the example shown, contact elements 127 are configured as female elements housed within insulative body 138, so as to receive protruding male contact elements from cradle 200.

The insulative body 138 includes a bottom face 121 and a back face 123. The bottom face 121 is exposed on the bottom 104 of handheld computer 100. The back face 123 is exposed on the back surface 110 (FIG. 1) handheld computer 100, so that the bottom face 121 and back face 123 form the exterior portion of coupling structure 120 when integrated with handheld computer 100. Preferably, back face 123 extends orthanormally from bottom face 121. On the bottom face 121 of handheld computer 100, coupling structure 120 includes openings for housing contact elements 127. The bottom surface 121 also includes an entrance opening 143 for each of the set of first apertures 126. The entrance openings 143 are each configured to receive latches 230, so that the latches 230 can latch onto the interior of the corresponding first aperture 126. The second set of apertures 128 may be positioned on the bottom surface 121 to receive guide members 232 of cradle 200. The set of first apertures 126 may be formed between the second set of apertures 128.

The set of first apertures 126 are each provided a back opening 147 on the back face 123 of insulative body 138. As will be described, the formation of openings 126 on bottom surface 121 and back surface 123 enable latch 230 to be received in a biased fashion, and subsequently released to a less biased state once confined with the opening 126.

FIG. 9 illustrates a top interior face 119 of coupling structure 120, opposing bottom face 121. The interior face 119 includes a plurality of leads 129 for extending communications to and from a printed circuit board not shown of handheld computer 100. The leads 129 are extensions of contact elements 127. The set of first apertures 126 are present on back face 123 as openings 147. The formation of the set of first apertures 126 on both the bottom face 121 and the back face 123 of handheld computer 100 facilitates corresponding latches 230 in engaging and latching with coupling structure 120.

FIG. 10 illustrates a front interior face 117 of coupling structure 120, opposing back face 123. The front interior face 117 includes frame 118 to support coupling structure 120 within the housing of handheld computer 100. The frame 118 may be formed from a separate material such as metal, and be extended into the set of first apertures 126 (FIG. 1) to further define an interior coupling structure for engaging latches 230 of cradle 200. The frame 118 may include features 114 to facilitate coupling of coupling structure 120 to the housing of handheld computer 100.

Figure 11:
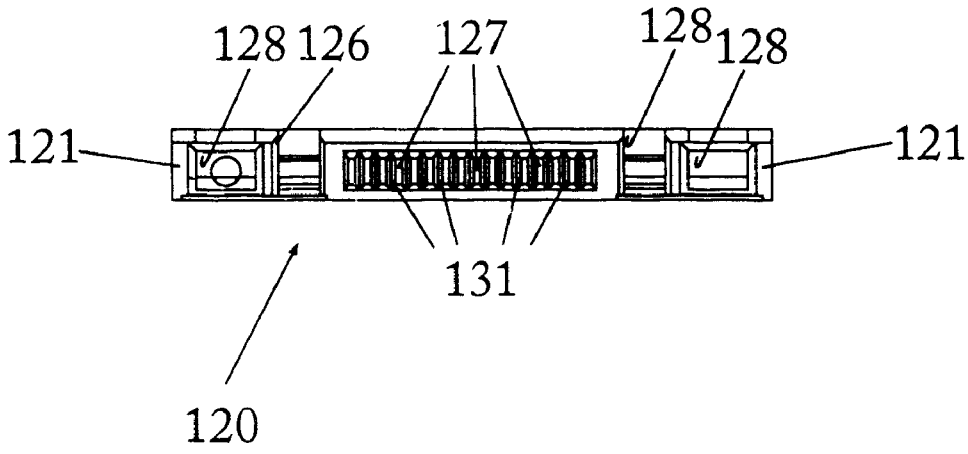
FIG. 11 illustrates the bottom face of the coupling structure for the handheld computer, under an embodiment of the invention.

FIG. 11 is a bottom view illustrating additional features of coupling structure 120, under an embodiment of the invention. As shown, the set of first apertures 126 are formed into the insulative body 138. The second set of apertures 128 are formed adjacent to the set of first apertures 126. The plurality of contact elements 127 reside between apertures 126. The insulative body 138 may include extensions 131 that extend between contact elements 127.

In an embodiment, first set of openings 126 are configured to receive latches, such as shown by latches 230 of cradle 200. An interior of the set of first apertures 126 include a structure for receiving and retaining latches 230. The frame 118 may extend into the interior portion of openings 126 to form a backing 117 for latch 230. The backing 117 may support latch 230 when latch 230 is inserted and returned to a less biased position.

D. Combined Coupling Structures of Handheld Computer and Cradle

Figure 12:
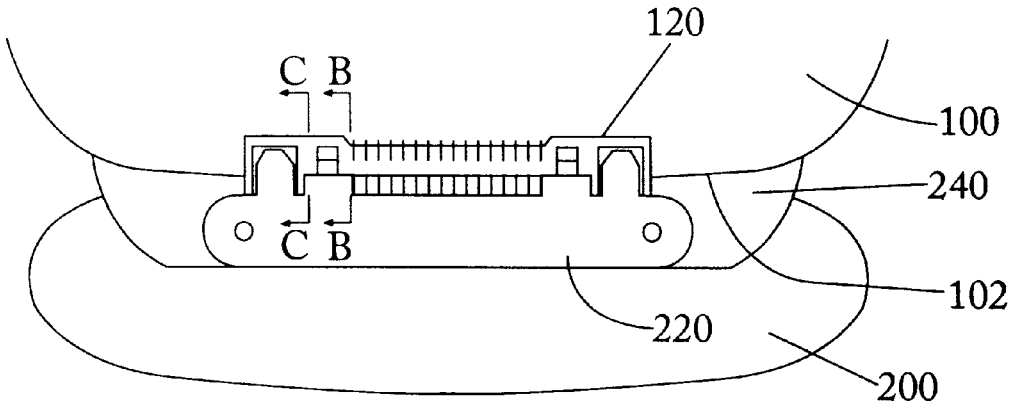
FIG. 12 is a frontal view of the coupling structure of the handheld computer being mated to the cradle coupling structure, under an embodiment of the invention.

FIG. 12 illustrates a handheld computer 100 coupled to a cradle 200, under an embodiment of the invention. The coupling structure 120 is provided on the bottom 104 of handheld computer 100 so as to couple to cradle coupling structure 220 when the handheld computer 100 is dropped into position. The cradle coupling structure 220 is provided on support structure 240 to receive coupling structure 120 while providing support for handheld computer 100. In this way, coupling structure 120 of handheld computer 100 is coupled to cradle coupling structure 220 so that connector 125 is mated with cradle connector 225. A first coupling between handheld computer 100 and cradle 200 is formed by guide members 232 extending into the second set of apertures 128. A second coupling is formed by latches 230 engaging the set of first apertures 126. The latches 230 may form a bias engagement with the apertures of coupling structure 120. A third coupling may be formed by contact elements 127 of connector 125, mated with contact elements 227 of cradle connector 225. As will be described, the positioning of the forces causing the couplings may be distributed to create a retention moment for handheld computer 100 on cradle 200.

Figure 13:
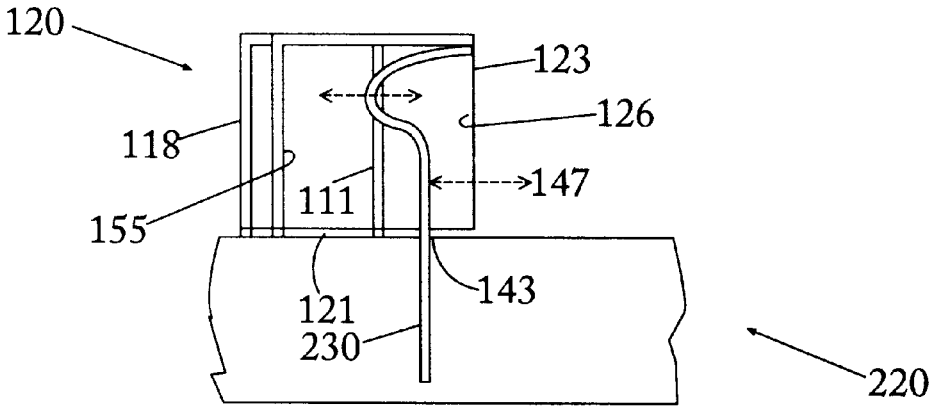
FIG. 13 is a side cross-sectional view of the cradle coupling structure coupled to the coupling structure of the handheld computer along lines B—B of FIG. 12, under an embodiment of the invention.

FIG. 13 is a side view of section B—B, shown in FIG. 12. The sectional view illustrates the engagement of latch 230 in first aperture 126 of handheld computer 100. The frame 118 of coupling structure 120 extends to a top wall 151 of insulative body 128. Interior to frame 118 and top wall 151 is a rib section 155, preferably formed as a portion of insulative body 128. Interior to the rib section 155 is a backing 117, preferably formed from the frame 118 to provide a back support and latching mechanism for latch 230. An opening 111 in backing 117 is dimensioned to receive a portion of latch 230. In this manner, the backing 117 may provide a buffer to allow the latches to return to an unbiased position after being inserted into apertures 126 from bottom face 121. Preferably, bent segment 237 extends partially into opening 111, with deflected region 235 passing through the plane of backing 117. Upon inserting into aperture 126, latch 230 is biased until the bent segment 237 is engaged and received by opening 111. Portions of latch 230 distal to deflected point 235 may pass through the back face 123 of handheld computer 100 during insertion, using back opening 147. Once engaged with opening 111, the latch 230 becomes less biased, so as to latch onto the opening 111. The shape and concavity of latch 230 enables the latch 230 to be inserted and removed from aperture 126 through engagement with backing 117 and opening 111, as well as through the entrance opening 143 and the back opening 147.

Figure 14:
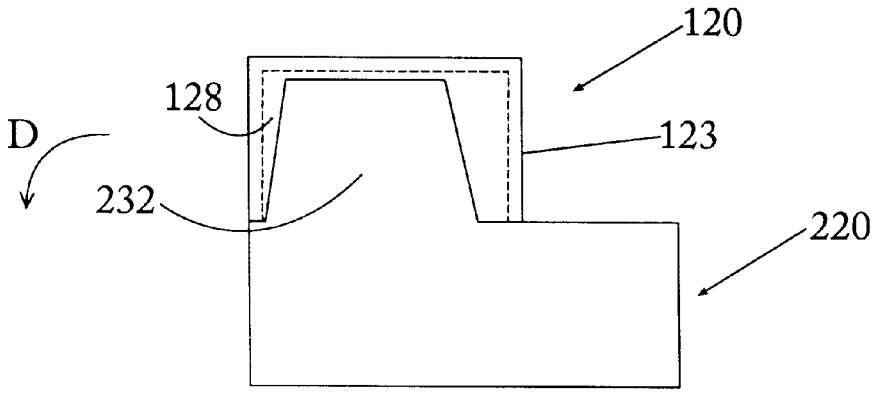
FIG. 14 is a side cross-sectional view of the cradle coupling structure coupled to the coupling structure of the handheld computer along lines C—C of FIG. 12, under an embodiment of the invention.
Figure 15:
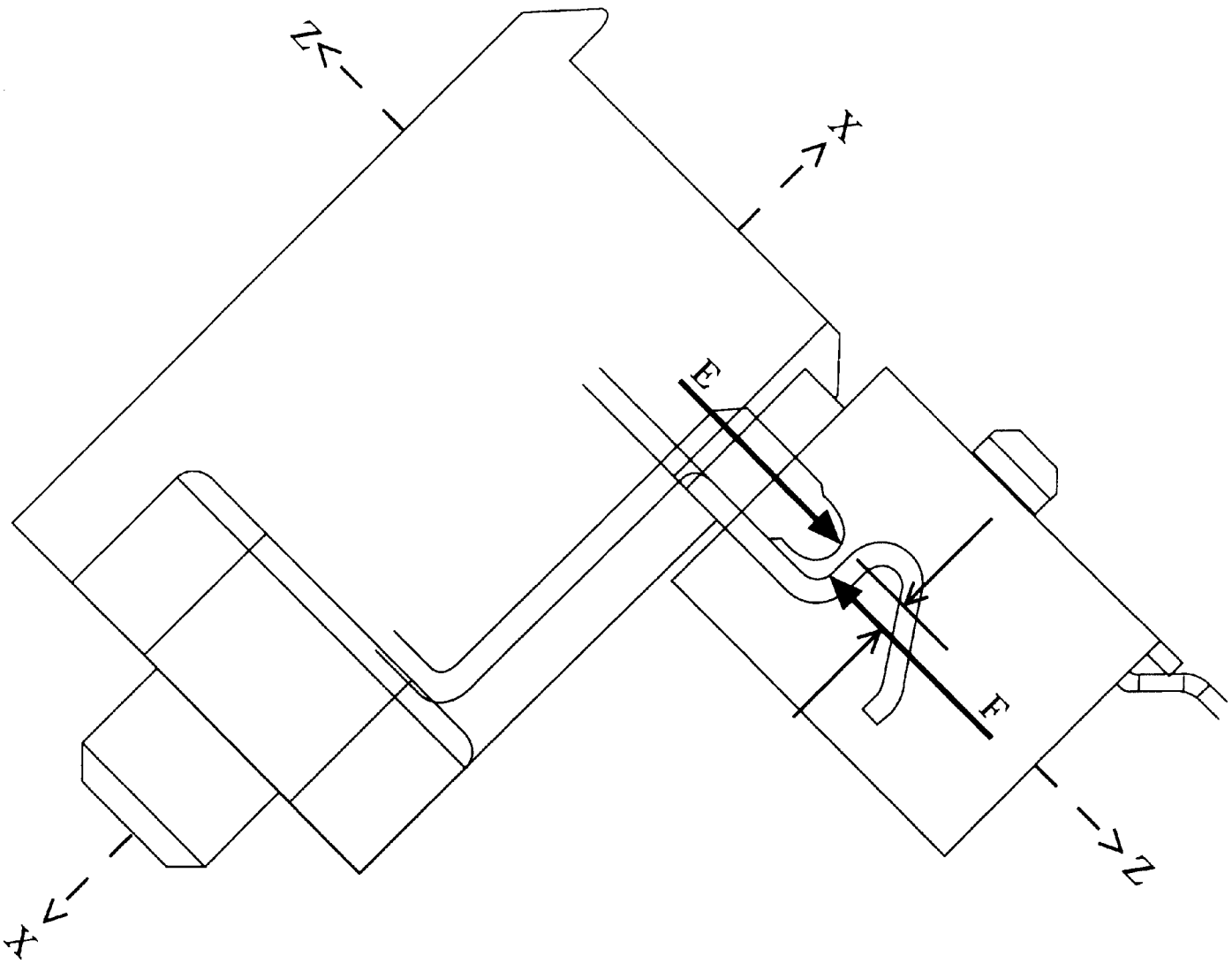
FIG. 15 illustrates the cradle coupling structure coupled to the coupling structure of the handheld computer, with a force diagram, under an embodiment of the invention.

FIG. 14 is a cross-sectional view along lines C—C of FIG. 12, illustrating an engagement of one of the guide members 232 on cradle 200 with a corresponding one of the second set of apertures on handheld computer 100. In an embodiment, the second aperture 128 is formed within insulative body 138 of coupling structure 120. In an embodiment, guide member 232 includes at least one tilted surface, and preferably to inward slanted surfaces 233 that extend vertically from cradle coupling structure 220. The geometry of guide members 232 enable each guide member 232 to move within the corresponding second aperture 128. The result is that handheld computer 100 can rock forward when coupling structure 120 is coupled to cradle coupling structure 220. The direction of the rocking motion is shown by directional arrow D. When rocked forward, each latch 230 is disengaged from opening 111 of backing 117, in the corresponding first aperture 126. The latches may be provided room to become unbiased and disengaged by back openings 147 of first apertures 126.S FIG. 15 is a schematic cross-sectional view of handheld computer 100 retained on cradle 200, under an embodiment of the invention. The diagram illustrates a retention force positively acting to retain handheld computer 100 on cradle 200. The retention force is in the form of a moment, that pushes handheld computer 100 against back support surface 248. The moment is created by the positioning of two coupling forces. The first coupling is formed by the engagement of latches 230 with the set of first apertures 126. The second coupling is formed by the positive engagement between connector 125 and cradle connector 225. More specifically, cradle connector 225 is assumed to include biased, male contact elements 227 that insert into female contact elements 127 of connector 125. The engagement between contact elements 227 (cradle 200) and 127 (handheld computer 100) is preferably a positive connection. The second coupling is offset from the first coupling, relative to an axis X, orthanormal to horizontal axis Y (coming out of the paper) and vertical axis Z. Directional arrows E and F illustrate the forces created by the first coupling (latch 230 and aperture 126) and second coupling (connector 125 and cradle connector 225). The forces E and F are displaced along axis X to create the moment. In addition, latches 230 may be biased when engaged to provide a retention force that positively retains handheld computer 100 on cradle 200.

Figure 16:
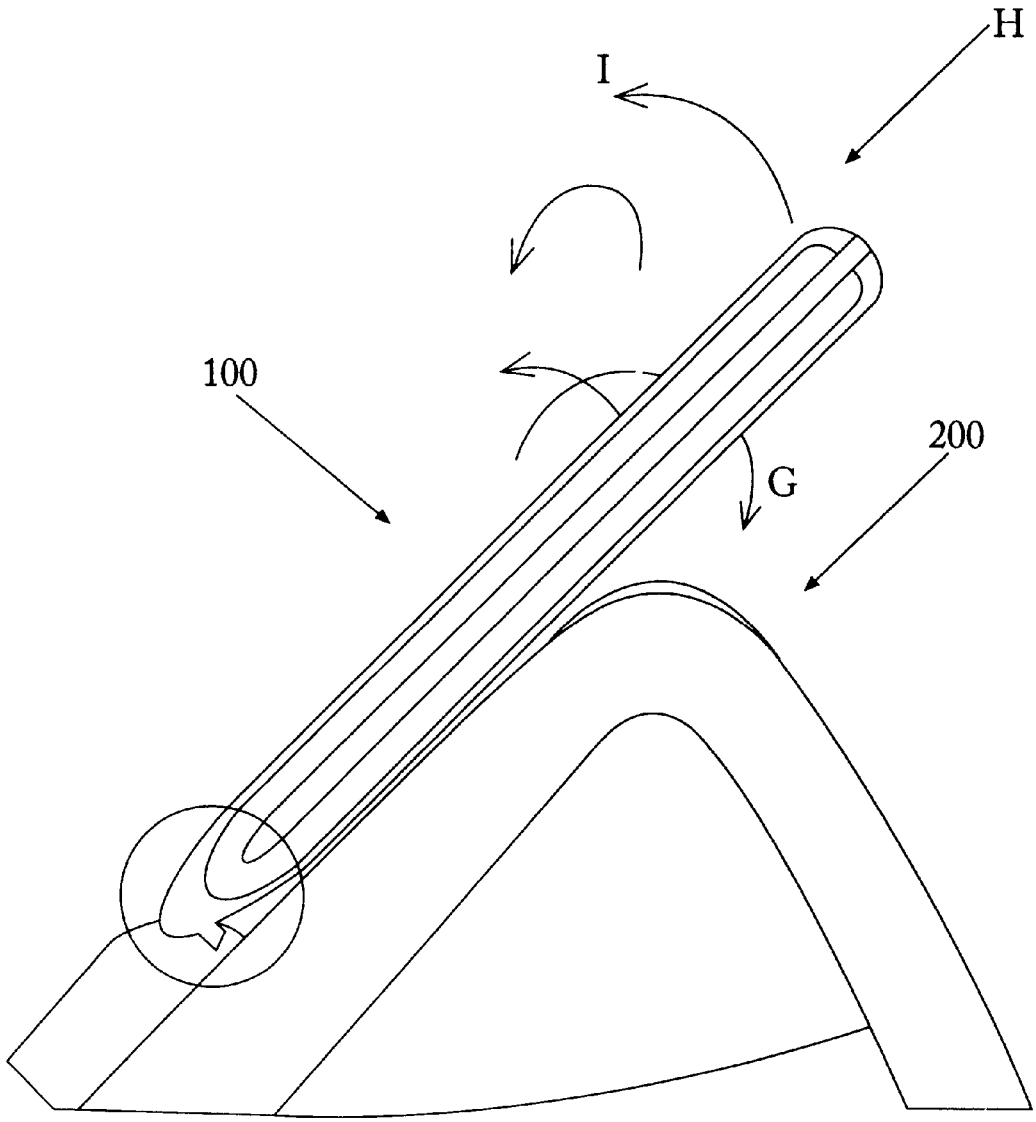
FIG. 16 is a side view of the cradle supporting the handheld computer, with a motion and a moment diagram, under an embodiment of the invention.

FIG. 16 is a side view of handheld computer 100 retained in an upright position on coupling structure 120 cradle 200. In this position, handheld computer 100 can be electrically connected to cradle 200. The arrow G shows the moment implemented on handheld computer 100 by the combination of the couplings formed between latches 230 and first apertures 126, as well as connectors 125 and cradle connector 225. The directional arrow H indicates the direction in which handheld computer 100 is dropped onto cradle 200 so as to rest on platform 245. When dropped in, cradle coupling structure 220 engages and latches onto coupling structure 120, with cradle connector 225 connecting to connector 125 of handheld computer 100. The directional arrow I indicates the direction in which handheld computer 100 can be decoupled from cradle 200. As indicated by arrow I, handheld computer 100 can be decoupled by being pulled forward from cradle 200. The geometry of guide members 132 in relation to second apertures 128 provide room for handheld computer 100 to rock forward. When rocked, latches 230 are each disengaged from openings 111 of the corresponding backings 117. Each of the latches 230 may be pushed through back openings 147 on coupling structure 120 to provide room for unbiasing the latch and decoupling it from the corresponding first apertures 126.

E. Cable Connectors for Handheld Computer

Figure 17:
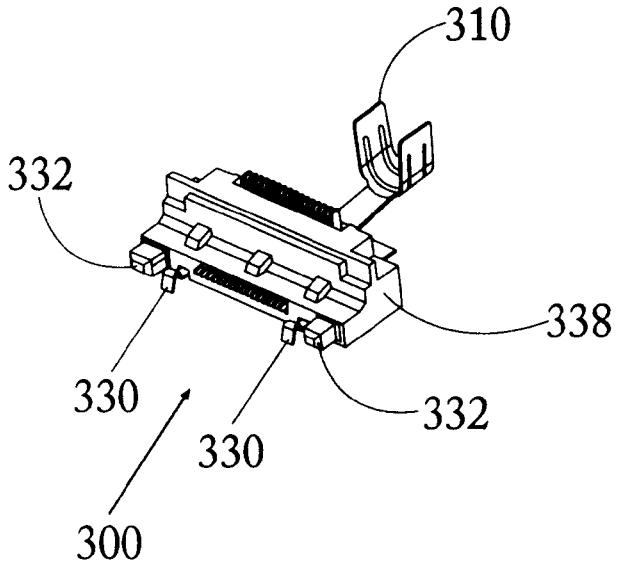
FIG. 17 is a frontal isometric view of a cable connector including a face for attaching to the coupling structure of the handheld computer, under an embodiment of the invention.
Figure 18:
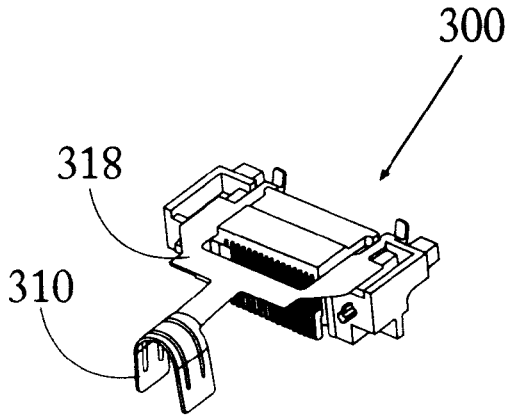
FIG. 18 is a back view of the cable connector, under an embodiment of the invention.

FIGS. 17–18 illustrate a cable connector 300 for use with coupling structure 120 of handheld computer 100, under an embodiment of the invention. The cable connector 300 may extend from a cable 310 to provide communications between handheld computer 100 and another type of accessory device. FIG. 17 illustrates a contact face 312 for cable connector 300. The contact face 310 includes features similar to those found with cradle coupling structure 220 of cradle 200. In particular, the features of contact face 310 are used to engage and attach to coupling structure 120 of handheld computer 100. The contact face 312 and its features may differ from cradle coupling structure 220 to accommodate a smaller form factor.

The cable connector 300 includes a pair of latches 330, positioned to engage and couple to first apertures 126 of coupling structure 120. The latches 330 may include the same geometry and dimensions of latches 230 of cradle 200. Positioned interior to latches 230 are a plurality of contact elements 337 of cable connector 300.

Positioned outwardly and adjacent to each latch is one of a pair of guide members 332. The guide members 332 are dimensioned to engage second apertures 128 of handheld computer 100. Preferably, guide members 332 have rectangular cross-sections, with no tilted surfaces for engaging second apertures 128. This is because cable connector 300 is not decoupled from handheld computer 100 by being rocked forward. Thus, guide members 332 of cable connector 300 are no required room to move within second apertures 128. A top surface 302 of connector 300 may include one or more wedge pieces 336. The wedge pieces 336 are optional components used to create a separate friction fit when the connector 300 is engaged with coupling structure 120.

The guide members 332 and latches 330 are formed on an insulative body 338 of connector 300. FIG. 18 is a back view of connector 300, showing cable 310 extending to a frame 318 for attaching to insulative body 338. The connector 300 may be coupled to handheld computer 100 by being inserted from a bottom direction so that the contact elements 337 form an electrical contact with elements 227 of cradle connector 225.

In an embodiment, contact elements 327 of connector 300 are configured as male elements that insert into female counterparts of handheld computer 100 (i.e. contact elements 127 of connector 125). The contact elements 327 create a positive mating force when engaged with counterparts on connector 125. As with previous embodiments, latches 330 may be offset along a width of the insulative body relative to contact elements 337. The result is that a coupling formed by contact elements 337 mating with contact elements 127 of handheld computer 100 combine with a coupling formed by latched 330 engaging the set of first apertures 126 to create a moment. The moment may be used to ensure the handheld computer 100 is directed towards remaining in contact with the connector 300. The moment may also be used to direct handheld computer 100 towards remaining in a stable relationship with connector 300, especially when handheld computer 100 is being operated through contact with the display and buttons.

F. Alternative Embodiments

FIG. 19 illustrates an embodiment in which an insulative body or coupling structure is provided a cam structure 270 to assist handheld computer 100 in rotating or lifting out of cradle 200. The cradle coupling structure 220 is assumed to include similar features of other embodiments described herein, except for inclusion of cam structure 270 on front face 204. That is, cradle coupling structure 220 includes latches 230 extending from contact face 202 to engage first apertures 126 of handheld computer 100. The cradle coupling structure 220 also includes guide members 232 to engage second apertures 128 of handheld computer 100. The plurality of contact elements 227 extend from cradle connector to mate with the connector 125 of handheld computer 100.

The cam structure 270 includes an elevated surface 272 that extends from front face 202. The elevated surface 272 is positioned to meet the bottom 104 of handheld computer 100 when handheld computer 100 is rotated forward to be removed from cradle 200. For example, directional arrow I in FIG. 16 shows handheld computer 100 being moved forward to be decoupled from cradle 200. When handheld computer 100 is moved forward, cam structure 270 makes contact with the bottom 104 so that handheld computer 100 is lifted off support structure 240. The result is that handheld computer 100 is lifted forward from cradle 200 more smoothly.

In other embodiments still, one or more features included with cradle coupling structure 220 may be provided on coupling structure 120. The features for coupling handheld computer 100 to cradle 200 may be interchangeable between coupling structure 120 and cradle coupling structure 220. For example, latches 230 may each be components of handheld computer 100, rather than cradle 200. Likewise, guide members 232 may be included on coupling structure 120 rather than cradle coupling structure 220. One or more of the first apertures 126 and second apertures 128 of handheld computer 100 may be elements of cradle coupling structure 220, rather than coupling structure 120.

Furthermore, the number of elements recited for each of coupling structure 120 and cradle coupling structure 220 may be varied. For example, while cradle coupling structure 220 is disclosed as having a pair of latches 230, other embodiments may provide for only a single latch 230, a plurality of latches 230, or sets of latches 230. Likewise, more of fewer guide members 232 may be provided on cradle coupling structure 220. The number of apertures 126, 128 on coupling structure 120 may be varied according to the number of guide members 232 and latches employed.

It is also possible to employ cradle coupling structure 220 or coupling structure 120 to include latches 230, but not guide members 232. The reverse may also be employed, so that guide members 232 may be used, but latches 230 are not.

G. CONCLUSION

The foregoing description of various embodiments of the invention has been presented for purposes of illustration and description. It is not intended to limit the invention to the precise forms disclosed. Many modifications and equivalent arrangements will be apparent.

What is claimed is:

1. An improved connector assembly for use with a handheld computer, the connector assembly comprising a first plurality of contact elements provided on the handheld computer, a second plurality of contact elements provided on a cradle that supports a bottom portion of the handheld computer, the second plurality of contact elements being configured to mate with the first plurality of contact elements, and a pair of latches positioned on opposite ends of the second plurality of connector elements to extend into a corresponding pair of apertures that are positioned on opposite ends of the first plurality of contact elements, wherein the cradle includes a platform, and the plurality of second contact elements extend along a vertical axis from the platform, and the cradle includes a back surface that extends from the platform along the vertical axis, and wherein the improvement comprises:

the pair of latch members being spaced apart from the second plurality of contact elements on the cradle so that a moment is created by (i) the first plurality of contact elements and the second plurality of contact elements being mated, and (ii) the pair of latch elements being extended into the pair of apertures, the moment causing the bottom portion of the handheld computer to bias into the cradle so as to bias the first plurality of contact elements into remaining in contact with the second plurality of contact elements;

and wherein the moment directs the bottom portion of the handheld computer towards at least one of the platform and the back surface of the cradle.

2. The collector assembly of claim 1, wherein the improvement further comprises the latch members being positioned to extend from the platform a distance from the back surface that is closer than a distance that separates the second plurality of contact elements from the back surface of the cradle.

* * * * *

UNITED STATES PATENT AND TRADEMARK OFFICE

CERTIFICATE OF CORRECTION

PATENT NO. : 6,558,189 B2
DATED : May 6, 2003
INVENTOR(S) : Groebe et al.

It is certified that error appears in the above-identified patent and that said Letters Patent is hereby corrected as shown below:

Column 10,
Line 60, replace “collector” with -- connector --.

Signed and Sealed this

Twenty-sixth Day of August, 2003

JAMES E. ROGAN
*Director of the United States Patent and Trademark Office*